United States Patent [19]

Tsuji

[11] 4,392,216

[45] Jul. 5, 1983

[54] INTEGRATED CIRCUIT FOR TIMEPIECE

[75] Inventor: Masuo Tsuji, Suwa, Japan

[73] Assignee: Kabushiki Kaisha Suwa Seikosha, Tokyo, Japan

[21] Appl. No.: 219,747

[22] Filed: Dec. 24, 1980

[30] Foreign Application Priority Data

Dec. 26, 1979 [JP] Japan ..... 54-173312
Sep. 17, 1980 [JP] Japan ..... 55-128794

[51] Int. Cl.[3] ..... G04B 25/00; G04B 1/00
[52] U.S. Cl. ..... 368/71; 368/204
[58] Field of Search ..... 368/76, 80, 82–84, 368/85–87, 155–160, 217–219, 239–242; 318/696

[56] References Cited

U.S. PATENT DOCUMENTS

| | | | |
|---|---|---|---|
| 4,110,968 | 9/1978 | Berney | 368/218 |
| 4,173,862 | 11/1979 | Nakagiri et al. | 368/203 |
| 4,217,540 | 8/1980 | Shimotsuma | 368/218 |
| 4,250,572 | 2/1981 | Yoshida | 368/71 |
| 4,278,325 | 7/1981 | Kondo et al. | 368/84 |

*Primary Examiner*—Vit W. Miska
*Attorney, Agent, or Firm*—Blum, Kaplan, Friedman, Silberman & Beran

[57] ABSTRACT

The integrated circuit, including MOS transistors, for driving the step motor of an analog display is substantially reduced in size by boosting the transistor gate voltage above the battery voltage applied to the source-drain terminals.

6 Claims, 8 Drawing Figures

FIG. 6
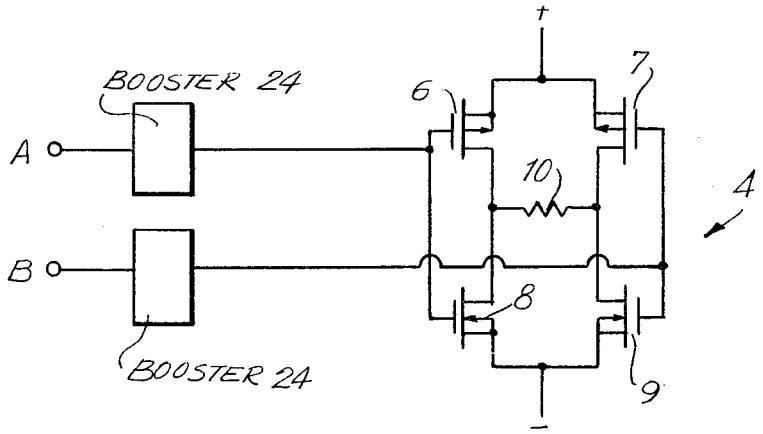
FIG. 7
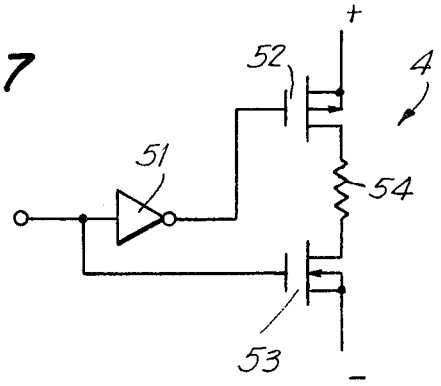
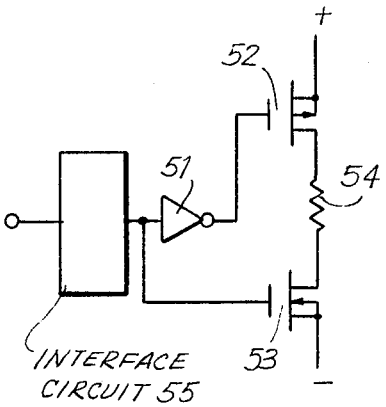
FIG. 8

INTEGRATED CIRCUIT FOR TIMEPIECE

BACKGROUND OF THE INVENTION

This invention relates generally to an integrated circuit for a timepiece of the type used for driving the step motor of an analog display, and more particularly, to a circuit where the size of the transistors is substantially reduced. In a conventional electronic analog timepiece, since there is only one supply voltage, generally a battery, the transistors for driving a step motor are driven by the same voltage as is used for integrated timekeeping circuits. Also, in hybrid watches having both an analog display and a digital display, the step motor driving transistors again are driven by the same battery voltage as in the simpler, purely analog timepiece. For driving the step motor, a high level of current, several hundred microamperes, flows, although the peak current continues for only a short time period. To accommodate this high current requirement, the CMOS integrated circuit structure, that is, in particular the driving transistors, requires a large surface area. Accordingly, the cost of the integrated circuit chip is greatly influenced by the area of the driving transistors. It is desirable that the size of the integrated circuit chip be small as possible so as to decrease the cost of the chip and also raise its reliability. When the area for the step motor driving transistors is made smaller, the entire area of the integrated circuit chip for the timepiece can be made smaller. The same object of smaller size is equally applicable in the hybrid watch having both analog and digital displays.

What is needed is an integrated circuit for a timepiece which has a small area and yet provides the high current carrying capability required for operation of the step motor in the analog mode of operation.

SUMMARY OF THE INVENTION

Generally, in accordance with the invention, an integrated circuit for an analog timepiece, which is small and reliable, is provided. The integrated circuit, including MOS transistors for driving the step motor of an analog display is substantially reduced in size by boosting the transistor gate voltage above the battery voltage applied to the sourcedrain terminals. In a hybrid timepiece having both analog and digital displays, the digital timekeeping circuits also operate at a voltage level elevated above the battery supply voltage. Elevation of the gate potentials allows for a reduction in transistor area while still providing the current flow required to drive the step motor for the analog display.

Accordingly, it is an object of this invention to provide an improved integrated circuit for a timepiece having small size and suited for driving a step motor for an analog display.

Another object of this invention is to provide an improved integrated circuit for a timepiece wherein transistor gates are driven with a higher potential than is provided for the source-drain, and transistor size is reduced.

A further object of this invention is to provide an improved integrated circuit for a timepiece having both digital and analog displays wherein voltage is elevated for digital timekeeping functions and for the transistor gates used in driving the step motor.

Yet another object of this invention is to provide an improved integrated circuit for an analog timepiece wherein a MOS transistor drives a step motor and the transistor source and substrate potentials are the same as that of the power supply and the gate is driven by a voltage generated within the integrated circuit which is a greater voltage than the power supply.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 6 is a circuit for driving a step motor in the watch of FIG. 5; and FIGS. 7 and 8 are alternative circuits similar to FIGS. 2 and 6, respectively.

DESCRIPTION OF THE PREFERRED EMBODIMENTS

Figure 1:
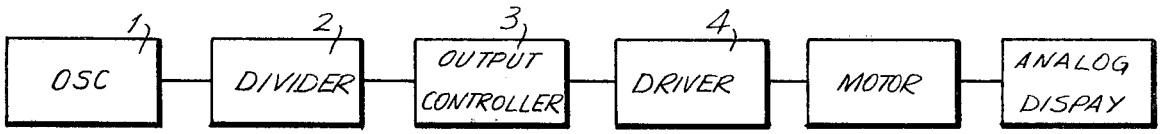
FIG. 1 PRIOR ART
FIG. 1 is a functional block diagram of an analog watch in accordance with the prior art.

This invention relates to a circuit for controlling the MOS transistors in an integrated circuit for a timepiece, the MOS transistors driving the indicating hands of a timepiece by means of a step motor. In the prior art, in the so-called analog display timepiece having a second, minute and hour hand, an oscillator circuit, divider circuit and MOS transistors for driving a step motor, hereinafter also referred to as the driving transistors, are all operated by an external supply voltage, which in a small timepiece is a battery. A functional block diagram of a conventional analog timepiece is shown in FIG. 1. The timepiece includes an oscillator circuit 1 outputting a high frequency standard signal, a divider circuit 2 receiving the output of the oscillator 1 and dividing down the standard frequency signal to a lower frequency signal for timekeeping. Also included are a circuit 3 for controlling the output of the divider 2 to provide the proper wave shape to a driver circuit 4. The output of the driver circuit 4 is fed to a step motor and analog display in the conventional manner. Within the oscillator circuit 1, a quartz crystal vibrator is connected to an integrated circuit (IC) so as to provide an oscillation having a stable frequency, generally, 32,768 Hz, for input to and division within the divider circuit 2. The control circuit 3, as stated, performs the function of determining the pulse width for driving the step motor which in turn drives the indicating hands of the analog display. The driving circuit 4 provides the electrical energy which is necessary to operate the step motor using the signals of the pulse width determined in the output control circuitry. Generally speaking, a high level of energy is delivered over a short period of time in pulses to operate the step motor.

Figure 2:
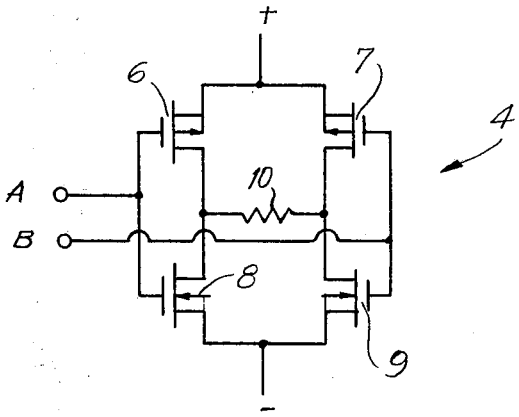
FIG. 2 PRIOR ART
FIG. 2 is a circuit of the prior art for driving a step motor in the watch of FIG. 1.

FIG. 2 is a detailed schematic of the driving circuit 4. P-channel transistors 6,7 are connected in series with N-channel transistors 8, 9 respectively across the external power source or battery (not shown). A resistor 10 represents the load of the step motor and it is connected between the P- and N-channel resistors in each branch of the circuit. The gates of the channel transistors in one branch, namely, the channel transistors 6, 8, are driven by a common gate signal A. The transistors in the other branch, namely, P-channel transistor 7 and N-channel transistor 9 are driven by another common gate signal B. Because the commonly driven transistors are of different types, it is apparent that only one transistor in each branch is capable of conducting when a driving signal pulse is applied to the gate. Pulse signals for controlling the gates are shown in FIG. 3 and identified as A and B to correspond with the gates of FIG. 2 where the signals are applied.

Figure 3:
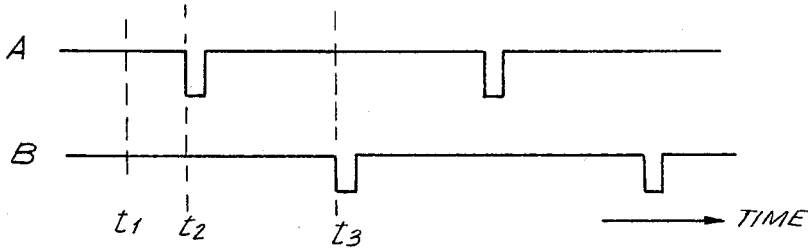
FIG. 3 is a chart of timing signals applied to the circuit of FIG. 2.

When both signals A, B are high, for example, at time t1 of FIG. 3, both N-channel transistors 8, 9 are electrically conductive whereby both ends of the load resistor 10 of the step motor are electrically connected with the negative terminal of the power supply. There is no voltage differential across the resistor 10 and no current flows in the step motor. When a voltage pulse of narrow width, generally, 3 to 10 milliseconds, is applied as shown for signal A at time t2 of FIG. 3, the P-channel transistor 6 and the N-channel transistor 9 are electrically conductive and the P-channel transistor 7 and N-channel 8 are turned off. During the time of the pulse, the load resistor 10 is connected in series with the transistors 6, 9 across the power supply terminals and a current flows from left to right (FIG. 2) through the step motor whereby the indication hands are advanced. Then, in time a similar pulse B, occurring at time t3 of FIG. 3, causes the P-channel transistor 7 and the N-channel transistor 8 to be electrically conductive while the transistors 6, 9 are turned off. This condition places the load resistor 10 in series with transistors 7, 8 across the power supply and a current flows through the step motor in the reverse direction. This is a brief description of an integrated circuit function for an analog timepiece.

When designing such an integrated circuit, the area of the driving circuit 4 presents a problem. The operation voltage is an external supply voltage which is generally a battery. The supply voltage drops at the time when the motor is driven because of the internal resistance of the battery. Thus, a large amplifying coefficient is neccessary for the driving transistors in order to provide the power required by the motor. Thus, the area of the driving circuit 4 becomes approximately one millimeter square, which amounts to 20 percent of the integrated circuit chip area in an ordinary integrated circuit for an analog timepiece. Thus, space, primarily area, is inefficiently used. Further, when driving a larged sized step motor, or when the other circuit portions are small in area, there have been instances where the driving transistors for the step motor occupy 50 percent of the integrated circuit chip area. Therefore, it is readily understandable that in view of the cost and reliability in manufacture of transistors, it is highly advantageous and profitable to make the area for the motor driving transistors as small as possible consistent with the load requirements.

Figure 4:
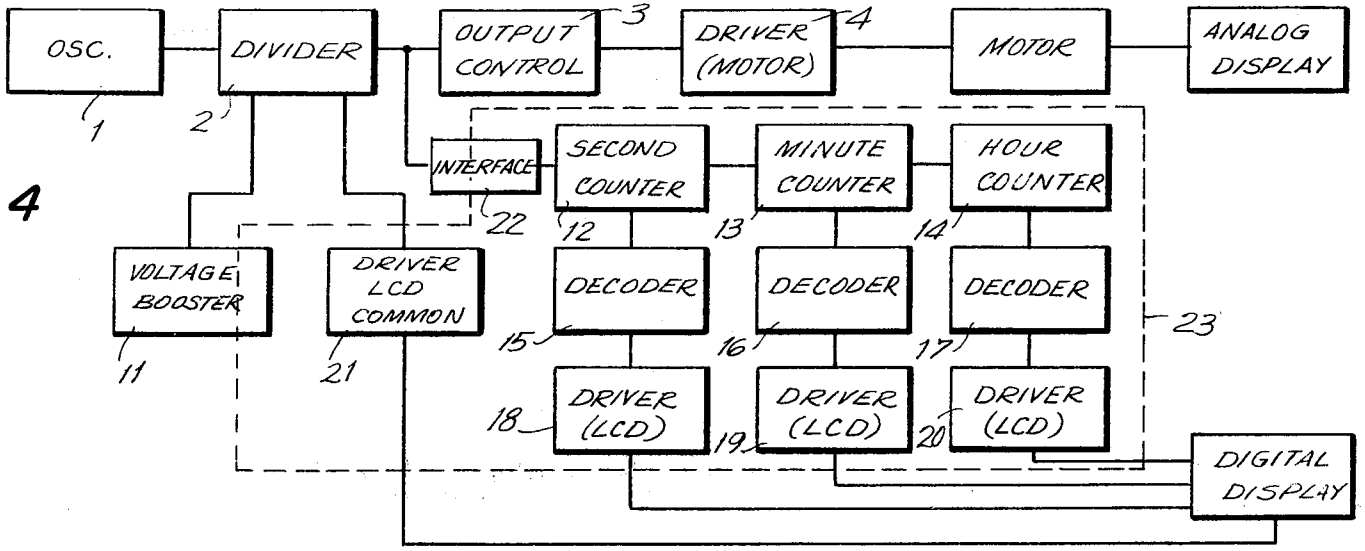
FIG. 4 is a functional block diagram of a conventional hybrid watch having both analog and digital displays.

In recent years, hybrid watches have appeared on the market. A hybrid watch includes the functions both of an analog watch and of a digital watch and has both types of display. A functional block diagram of a hybrid watch is shown in FIG. 4. The timepiece includes an oscillator circuit 1 for producing a high frequency standard signal, a divider circuit 2 for dividing down said high frequency signal to a lower frequency signal suitable for timekeeping, an output controlling circuit 3, and a circuit 4 for driving a step motor and analog display. These are the same components as in the ordinary analog watch of FIG. 1. Additional circuit blocks are necessary for performance of the digital functions, including a second counter 12, minute counter 13, and hour counter 14. Decoders 15, 16, 17 transduce the contents of the second, minute and hour counters 12, 13, 14 respectively into necessary timekeeping data. Driving circuits 18, 19, 20 for driving a liquid crystal display operate in accordance with the outputs of the respective decoders. A booster circuit 11 boosts the external supply, or battery voltage, to double or three times the normal source level. Voltage boosters to accomplish such a doubling or tripling in voltage are well known and need no further description here. The voltage output of a single silver oxide battery is not sufficient for driving and display of many kinds of liquid crystals. Therefore, the liquid crystal display is driven after boosting the voltage by means of a booster circuit 11.

A driver circuit 21 connects to the common side of the liquid crystal electrodes in a known manner and an interface circuit 22, namely, a transducer circuit for raising the signal level generated by the battery voltage to the same level as the boosted voltage from the booster 11. This interface circuit 22 may be inserted anywhere so long as the liquid crystal drivers 18, 19, 20 are driven by a boosted voltage. However, generally speaking, the interface circuit 22 is inserted between the second counter 12 and the divider 2. A broken line 23 shows the circuit portions which are driven by a boosted voltage. In the timepiece of FIG. 4, the driving transistors in the driver 4 are driven by the external supply voltage of the battery in the same manner as shown in FIGS. 1 and 2. Thus, in the integrated circuit for a hybrid watch as in FIG. 4, the area for the step motor driving transistors will be substantially the same as the area for the same transistors of the integrated circuit for a watch which is solely analog as in FIG. 1.

Figure 5:
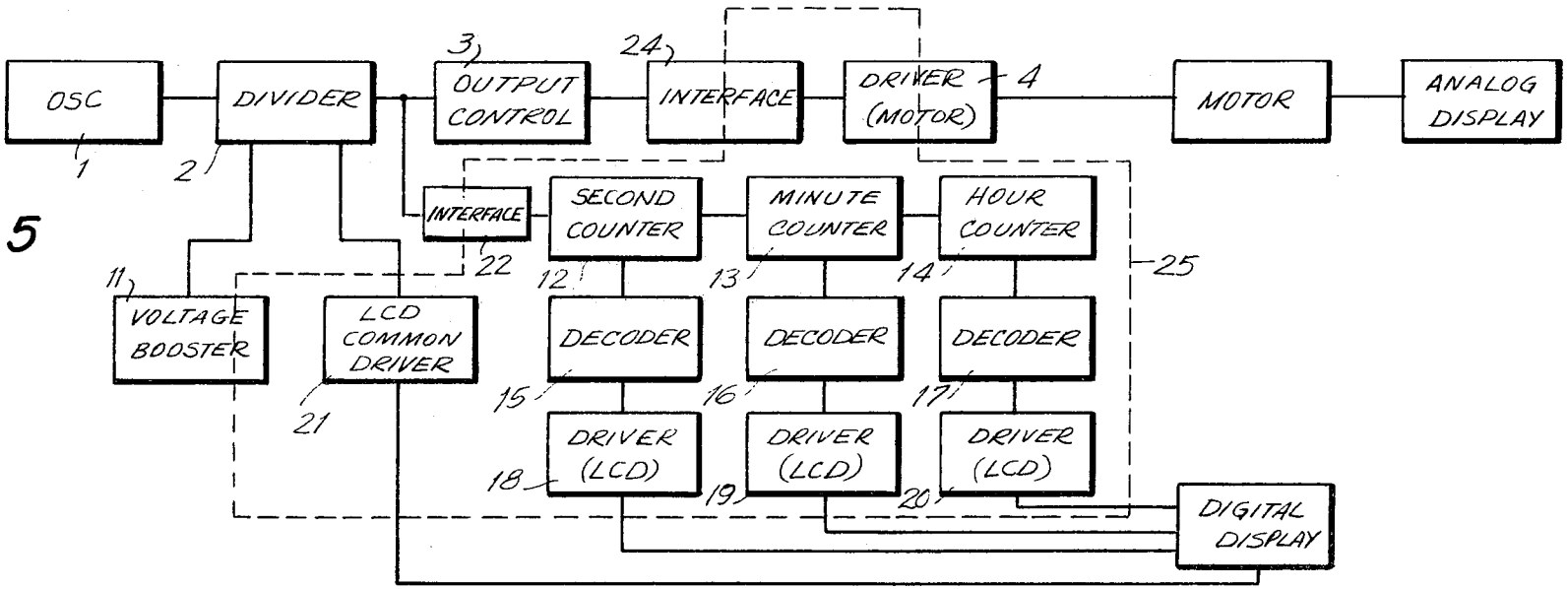
FIG. 5 is a functional block diagram of a hybrid watch in accordance with this invention.

In a timepiece in accordance with this invention, it is an object that the area of the driving transistors is made small so as to achieve beneficial results with regard to cost and reliability of the integrated circuit. A functional block diagram of a hybrid timepiece in accordance with this invention is shown in FIG. 5. The oscillator 1, divider 2, output control 3, voltage booster 11, counters 12, 13, 14, decoders 15, 16, 17, drivers 18, 19, 20, interface circuit 22, motor and analog and digital displays are the same as those shown in a conventional hybrid watch of FIG. 4.

In FIG. 5, an interface circuit 24 is located between the output control circuit 3 and the driving circuit 4, and more particularly, the circuit 24 is between the signals from the output control circuit 3 and the gates of the step motor driving transistors as more clearly shown in FIG. 6. The interface circuits 24 boost the voltage of the signals A, B (FIG. 3) so that the magnitude of change in voltage when the pulses occur is changed from the level of the external supply or battery to that of a boosted voltage, for example, doubled or tripled. As in FIG. 2, the source-drain current through the transistors 6, 7, 8, 9 is drawn directly from the external supply voltage or battery without boosting. Use of the battery voltage directly is continued because a boosted voltage cannot provide a sufficiently large current output for driving a step motor although the boosted voltage can control the gates. A broken line 25 shows the circuit portions which are driven by a boosted voltage.

As stated, FIG. 6 is a circuit diagram similar to FIG. 2 and including interface circuits 24 connected to the gates of the driving transistors. The voltage level of the gate controlling signal A, B (FIG. 3) in accordance with this invention, are made the same as the internal boosted voltage from the booster 11. By raising the effective gate voltage on the driving transistors 6, 7, 8, 9, the area of the driving transistors can be decreased. Assume the external supply voltage or battery voltage (VGS) of 1.58 volts drops to 1.3 volts at the time of driving the step motor because of the internal resistance of the external power source. Further, assume that a current which flows in the load resistor 10 is 500 microamperes; ON potential (VDS) of the P-channel transistor 6 in FIG. 2 is 0.1 volts; the threshold voltage (Vth) is 0.75 volts and the amplifying rate of the transistor is $\beta$. Then, an approxiate equation for current in a conventional circuit is as follows:

$$I=\beta\{(VGS-Vth)\times VDS-\tfrac{1}{2}VDS^2\}500\times10^{-6}=\beta\{(1.3-0.75)\times0.1-\tfrac{1}{2}0.1^2\}\beta\div0.92\times10^{-2} \quad (1)$$

I: current
$\beta$: amplifying rate
VGS: voltage between gate and substrate
Vth: threshold voltage
VDS: voltage between drain and substrate When as a result of the interface circuits 24, the voltage is doubled from 1.3 to 2.6 and this value is reduced to 2.5 volts because of losses and inefficiencies in the booster, the following equation is obtained:

$$500\times10^{-6}=\beta\{(2.5-0.75)\times0.1-\tfrac{1}{2}0.1^2\}\beta\div0.29\times10^{-2} \quad (2)$$

The equations 1, 2, indicate that the necessary amplifying rate $\beta$ of the transistors in a circuit in accordance with this invention is approximately 23 percent of the amplifying rate required in the conventional circuit of FIG. 2 without voltage boosting in order to produce the same assumed value of driving current, that is, in this example 500 microamperes. When the external power source or battery and the internal boosted power source 11 have their plus sides in common, this arrangement is effective on the P-channel transistor. When the internally boosted power source and the external power source are connected in common on the negative side in view of the integrated circuit manufacturing and circuit arrangement, the same beneficial effect results in N-channel transistors. Even considering the area of the interface circuits 24, the area of a driving transistor and the associated interface circuit is about one-third of the area for the conventional transistor. Circuit arrangement and the area of the integrated circuit chip becomes smaller.

Additionally, another result can be anticipated when the external power supply or battery has an internal impedance. Assuming again that the external supply or battery voltage is 1.58 volts just before the time when it drives the step motor. Also assume that the voltage drops to 1.30 volts at the time when the step motor is driven. In such a case, the voltage can be boosted before the motor is driven, giving a result, for example, with a doubler, of $1.58\times2=3.16$ volts. Since the time for driving the step motor is short and a suitable capacitor is inserted in parallel with the boosted voltage, it is possible to maintain the voltage level of the boosted power source when the external supply voltage or battery voltage drops for only a short period of time as is the case here. Therefore, the value of $\beta$ can be reduced by 15 percent from the value in equation 2, and the area of the integrated circuit can also be decreased by approximately another 15 percent.

The circuit construction in accordance with this invention is not limited only to the construction wherein the interface circuit 24 is positioned between the output control circuit 3 and the driving transistors in the driver 4. The same beneficial effect of reducing the area for the transistors can be obtained by positioning interface circuitry for voltage boosting between the divider stages 2 and the output control circuit 3. A circuit construction in accordance with this invention is applicable not only to a transistor for driving a step motor but also in other applications. When the potentials of the source of a driving transistor and of the substrate are dependent upon an external supply voltage, and when the controlling gate of the driving transistor is driven by a voltage increased above the value of the external supply voltage by means of an internal booster circuit, the area of the driving transistor can be decreased.

For an integrated circuit in which a great capacity is required for a driving transistor and in which the area of the driving transistor occupies a substantial part of the chip area, some beneficial effect is obtained by boosting the voltage only for controlling the gate of the driving transistor even when there is no necessity of other internal voltage boosting. This is so whether such an integrated circuit is used for a hybrid watch or for a purely analog watch. In such a construction, with a booster circuit capable only of increasing the voltage of the gate of a driving transistor, the area of the booster circuit is also small. An externally attached capacitor (not shown) for boosting voltage, which is necessary for an integrated circuit in a hybrid watch can be incorporated in a small area within the integrated circuits.

In a timepiece in accordance with this invention, a lithium battery having a voltage of more than three volts has been used with satisfactory results. However this invention is also suited to the situations where the voltage is three volts or less.

FIGS 7 and 8 show alternative circuits for the driver 4 of FIGS. 4 and 5 respectively. In these circuits the load resistor 54 of the step motor is located in series with a P-channel MOS transistor 52 and an N-channel MOS transistor 53. The series circuit is connected across the external power supply or battery as described above. When a high signal is applied to the input of an invertor 51, and to the gate of the N-channel transistor 53, both transistors 52, 53 are conductive and current flows through the motor resistor 54 to drive the analog display. In FIGS. 7 and 8 only a single input to the invertor is necessary to drive the motor whereas in the previously described circuits of FIGS. 2 and 6 two signals were required. The area required for the transistors on the integrated circuit is reduced in the circuit of FIG. 8 in accordance with this invention where the signal to the inverter 51 first passes through an interface circuit 55 wherein the voltage level is boosted above the voltage level of the external power source. As explained in relationship to equations 1 and 2 above, boosting the voltage applied to the gates of the transistors reduces the amplification rate which is needed to provide a given quantity of current for driving the step motor. Accordingly, the area of the integrated circuit devoted to the transistor is reduced, and size, cost and reliability are improved.

It can thus be seen that the objects as forth above, among those made apparent from the preceding description, are efficiently attained and, since certain changes may be made in the above construction without departing from the spirit and scope of the invention, it is intended that all matter contained in the above description as shown in the accompanying drawings shall be interpreted as illustrative and not in a limiting sense.

It is also to be understood that the following claims are intended to cover all of the generic and specific features of the invention herein described and all statements of the scope of the invention which as a matter of language, might be said to fall therebetween.

What is claimed is:

1. A circuit for a hybrid timepiece, said timepiece comprising:

timekeeping circuit means including oscillator means for generating a high frequency standard signal, divider means for dividing down said high frequency standard signal to a lower frequency timekeeping signal, controller means for shaping signals from said divider means;

an external power supply for powering a portion of the circuits of said hybrid timepiece;

booster circuit means operating from said power supply for outputting a boosted voltage at a level exceeding the voltage of said power supply, another portion of circuits of said timepiece operating on said boosted voltage;

a liquid crystal display and means for driving said liquid crystal display, said means for driving said liquid crystal display operating on said boosted voltage in response to said lower frequency timekeeping signal;

a step motor driving an analog display;

integrated circuit means for providing driving current pulses to said step motor in response to said shaped signals from said divider means, said integrated circuit means for providing driving current pulses to said step motor including at least one CMOS transistor pair, the source and drain terminals of said at least one CMOS transistor pair operating on said power supply voltage, the gates of said at least one CMOS transistor pair being driven by signals at said boosted voltage level.

2. A circuit for a timepiece as claimed in claim 1, wherein the substrate and sources of said at least one transistor pair are connected in common with said external power supply.

3. A circuit for a timepiece as claimed in claim 1 or 2, wherein said shaped signals are applied to said gates.

4. A circuit for a timepiece as claimed in claim 3, wherein said step motor is in series with source/drain terminals of said at least one transistor pair across said external power supply.

5. A circuit for a timepiece as claimed in claim 1, wherein said controller means includes, counter means for seconds, minutes and hours, said counters receiving signals from said divider means, decoders for the outputs of said counters, and digital display drivers inputted signals from said decoders and outputting signals to said digital display.

6. A circuit for a timepiece as claimed in claim 5, wherein at least a portion of said timepiece circuit in addition to said means for providing step motor driving current pulses, is an integrated circuit.

* * * * *